US009337520B2

(12) United States Patent
Hung

(10) Patent No.: US 9,337,520 B2
(45) Date of Patent: May 10, 2016

(54) BLEND STRIP AND FILTER USING SAME

(71) Applicant: HON HAI PRECISION INDUSTRY CO., LTD., New Taipei (TW)

(72) Inventor: Ruei-Yun Hung, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 141 days.

(21) Appl. No.: 14/160,563

(22) Filed: Jan. 22, 2014

(65) Prior Publication Data

US 2014/0210573 A1 Jul. 31, 2014

(30) Foreign Application Priority Data

Jan. 31, 2013 (CN) ..... 2013 1 0038155

(51) Int. Cl.
*H01P 1/205* (2006.01)
*H01P 7/04* (2006.01)

(52) U.S. Cl.
CPC ..... *H01P 1/2053* (2013.01); *H01P 7/04* (2013.01)

(58) Field of Classification Search
CPC ..... H01P 1/202; H01P 1/2053; H01P 1/2056; H01P 7/04
USPC ..... 333/206, 207, 222–224
See application file for complete search history.

(56) References Cited

U.S. PATENT DOCUMENTS

| | | | | |
|---|---|---|---|---|
| 7,224,242 | B2 * | 5/2007 | Taylor | 333/99 S |
| 2002/0038720 | A1 | 4/2002 | Kai et al. | |
| 2006/0139128 | A1 * | 6/2006 | Ala-Kojola | 333/207 |
| 2012/0007697 | A1 * | 1/2012 | Tiihonen | 333/202 |

FOREIGN PATENT DOCUMENTS

| | | | |
|---|---|---|---|
| CN | 101034881 | A | 9/2007 |
| CN | 101626101 | A | 1/2010 |
| CN | 102361117 | A | 2/2012 |
| TW | 200939624 | A | 9/2009 |
| TW | M398206 | U1 | 2/2011 |

OTHER PUBLICATIONS

LV Yi-Zhe, Wang Yi-Dong, Ju Ji-Long;Research on Linear Filter with Cross-Coupling;Journal of Communication University of China (Science and Technology); Mar. 30, 2008; pp. 25-27;Bei Jing.

* cited by examiner

*Primary Examiner* — Robert Pascal
*Assistant Examiner* — Gerald Stevens
(74) *Attorney, Agent, or Firm* — Novak Druce Connolly Bove + Quigg LLP

(57) ABSTRACT

A filter includes a case, a number of resonant columns received in the case, a partition walls received in the case and located between the adjacent resonant columns, a number of blend strips fastened on the partition walls, and a cover covering on the case. The cover defines a number of regulating through hole corresponding to the resonant columns and the blend strips and includes a number of regulating bolts passing through the regulating through hole to couple with the resonant columns and the blend strips. The regulating bolts move upwards and downwards in the regulating through holes to regulate a transmission zero of the filter.

17 Claims, 4 Drawing Sheets

BLEND STRIP AND FILTER USING SAME

FIELD

The disclosure generally relates to electronic equipment, and particularly to a blend strip and a filter using same.

BACKGROUND

A filter includes a number of resonant columns and a number of blend strips located between two adjacent resonant columns. The frequency tuning range of the filter is depended on a shape of the blend strips. However, a coupling area of the blend strip is too small, which leads to a narrow frequency tuning range of the filter.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustraconducting materialg the principles of the disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

Figure 1:
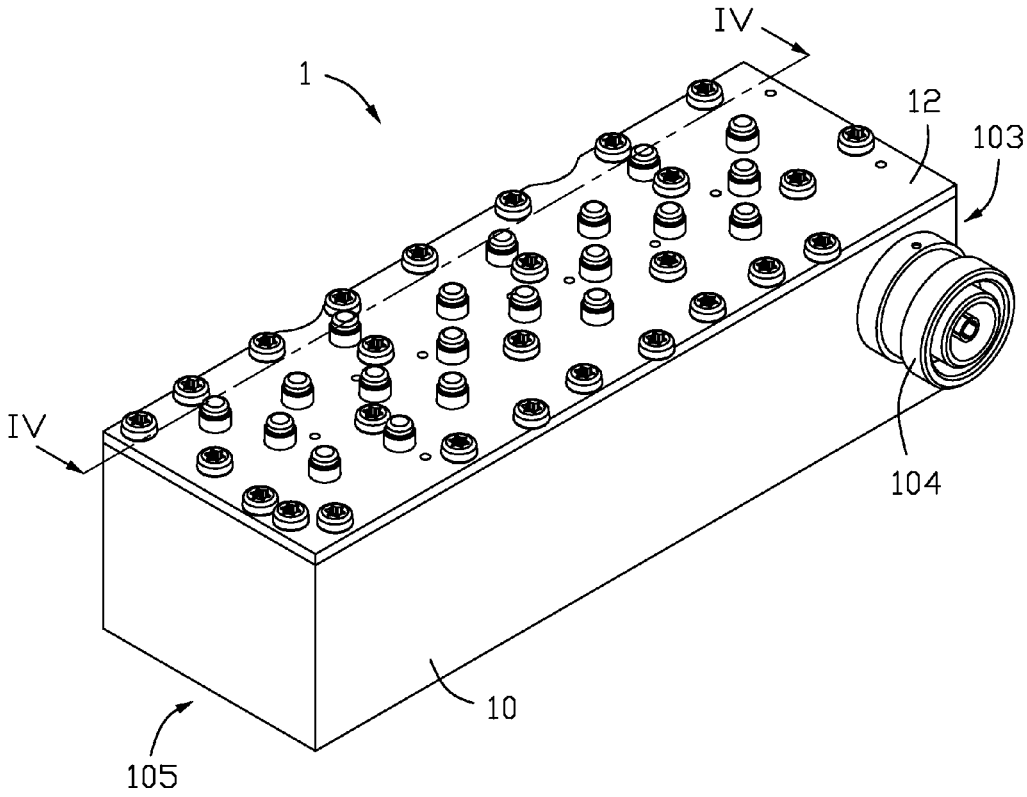
FIG. 1 is an isometric, assembled view of a filter in accordance with an exemplary embodiment.
Figure 2:
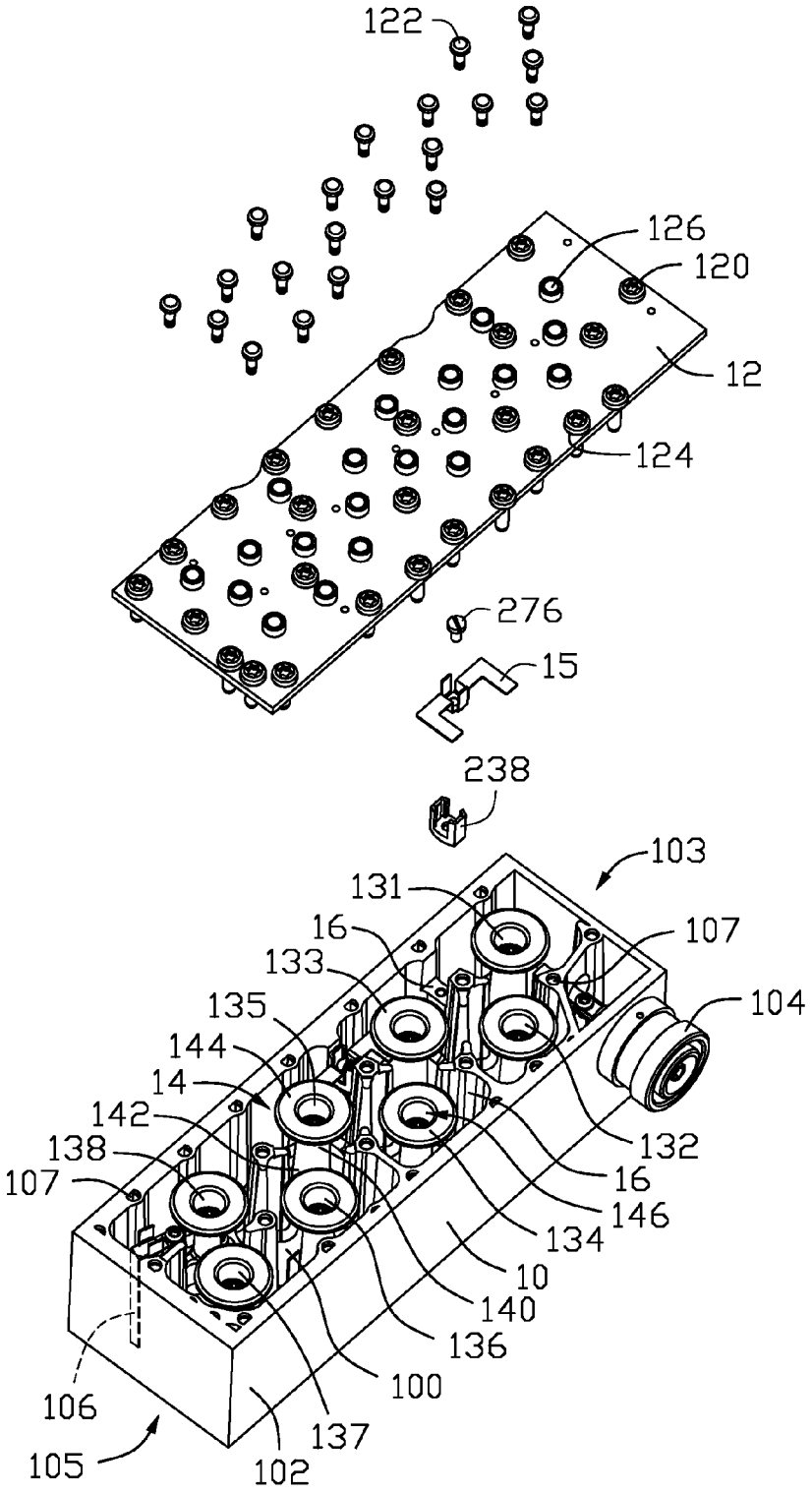
FIG. 2 is an isometric, exploded view of the filter of FIG. 1.

FIGS. 1 and 2 show an embodiment of a filter 1. The filter 1 includes a case 10, a cover 12 covering the case 10, a number of resonant columns 14 received in the case 10. In addition, a number of partition walls 16 received in the case 10 and located between the adjacent resonant columns 14 to separate the adjacent resonant columns 14, and a number of blend strips 15 fastened on the partition walls 16. The case 10 includes a base board 100, a number of sidewalls 102 extending from a periphery of the base board 100, a signal input port 104, and a signal output port 106. The base board 100 and the sidewalls 102 cooperatively define a receiving space receiving the resonant columns 14 and the partition walls 16.

Each of the resonant columns 14 includes a bottom end 142 coupled to the base board 100, a top end 140 away from the base board 100, and a flange 144 radially extending from the top end 140. The flange 144 is a hollow ring and defines a coupling hole 146 in a center of the flange 144.

The case 10 includes a first side 103 and a second side 105 opposite to the first side 103 in a longitudinal direction of the case 10. The signal input port 104 is set on the sidewalls 102 near the first side 103. The signal output port 106 is set on the base board 100 near the second side 105. In this embodiment, there are eight resonant columns 14 correspondingly located from the first side 103 to the second side 105 and denoted as a first resonant column 131, a second resonant column 132, a third resonant column 133, a fourth resonant column 134, a fifth resonant column 135, a sixth resonant column 136, a seventh resonant column 137, and a eighth resonant column 138. The resonant columns 14 are evenly divided into two groups. The resonant columns 14 in each group are lined along the longitudinal direction of the case 10. The first resonant column 131, the third resonant column 133, the fifth resonant column 135, and the eighth resonant column 138 are orderly lined from the first side 103 to the second side 105 and considered a first group. The second resonant column 132, the fourth resonant column 134, the sixth resonant column 136, and the seventh resonant column 137 are orderly lined from the first side 103 to the second side 105 and are considered a second group. The resonant columns 14 of the first group are misaligned with the resonant columns 14 of the second group. The partition walls 16 are set between each two adjacent resonant columns 14 in the same group to define a jagged first path alternately passing through the resonant columns 14 of different groups. In this embodiment, the jagged first path orderly passes through the first resonant column 131, the second resonant column 132, the third resonant column 133, the fourth resonant column 134, the fifth resonant column 135, the sixth resonant column 136, the seventh resonant column 137, and the eighth resonant column 138.

The cover 12 includes a number of fastening bolts 120 and a number of regulating bolts 122. The cover 12 defines a number of fastening through holes 124 and a number of regulating through holes 126. The case 10 defines a number of threaded holes 107 in a top of the partition walls 16 and a top of the sidewalls 102.

Figure 3:
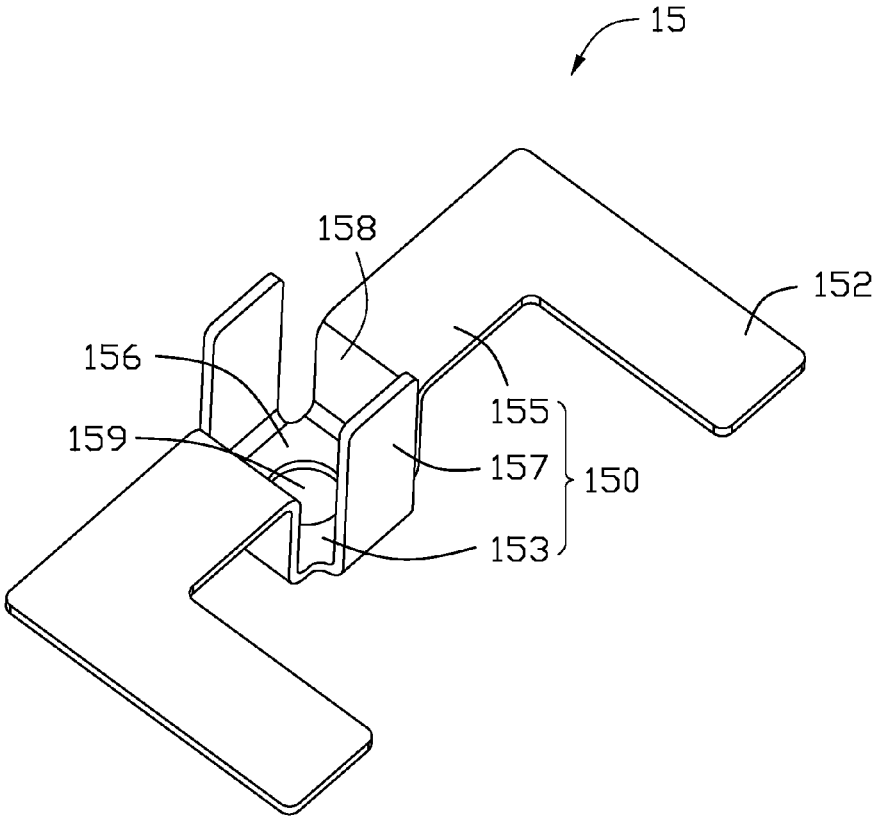
FIG. 3 is an isometric view of a blend strip of the filter of FIG. 2.

FIG. 3 shows that each of the blend strips 15 includes a main body 150 and a pair of arms 152. The main body 150 is an elongated plate. The arms 152 extend from two opposite ends of the main body 150 towards a same direction. The arms 152 are substantially perpendicular to the longitudinal direction of the main body 150. The main body 150 includes an upper part 155, a lower part 153, and a pair of wings 157. The lower part 153 is located at a center of the main body 150. The lower part 153 is bent downwards relative to the upper part 155. The lower part 153 includes a bottom plate 156 parallel to the upper part 155 and a pair of connecting walls 158 interconnecting the bottom plate 156 with the upper part 155. In this embodiment, the connecting walls 158 are substantially perpendicular to the upper part 155. The lower part 153 defines a connecting through hole 159 at a center of the bottom plate 156. The pair of wings 157 correspondingly extends from two opposite sides of the lower part 153. The wings 157 extend along a direction perpendicular to a plane defined by the main body 150 and the arms 152.

Figure 4:
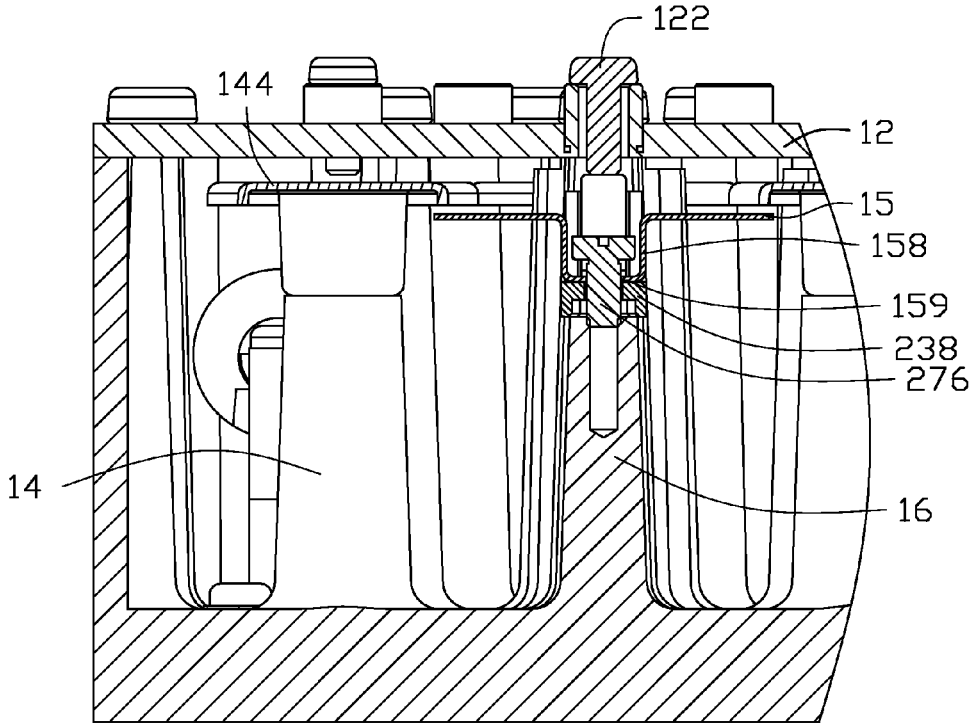
FIG. 4 is an isometric, cross-sectional view of the filter of FIG. 1.

FIGS. 2 and 4 show that in assembly, the blend strips 15 are put on the partition walls 16 located between two adjacent resonant columns 14 of the same group. The connecting through hole 159 of each blend strip 15 is aligned with the threaded hole 107 of the partition walls 16. An insulating cushion 238 is placed between the blend strips 15 and the partition walls 16. The blend strips 15 are fastened to the partition walls 16 by a number of insulating bolts 276 passing through the connecting through holes 159 and screwing into the threaded holes 107. The fastening bolts 120 pass through the fastening through holes 124 and screw into the corresponding threaded holes 107 to fasten the cover 12 on the case 10. The regulating bolts 122 pass through the regulating through holes 126 and align to the coupling holes 146 of the resonant columns 14 and the connecting through holes 159. The pair of arms 152 is corresponding aligned to the two adjacent resonant columns 14 but do not contact with the resonant columns 14. In this embodiment, there are two blend strips 15 correspondingly fastened to the partition walls 16 between the first resonant column 131 and the third resonant column 133 and between the third resonant column 133 and the fifth resonant column 135.

In use, signal is input to the filter 1 via the signal input port 104 and is transmitted to the signal output port 106 through the jagged first path. Because the signal can be transmitted through the blend strips 15, the signal is also transmitted through a second path passing through the blend strips 15. In this embodiment, a first blend strip 15 is located between the first resonant column 131 and the third resonant column and a second blend strip 15 is located between the third resonant column 133 and the fifth resonant column 135. The second path passes through the first resonant column 131, the first blend strip 15, the third resonant column 133, the second blend strip 15, the fifth resonant column 135, the sixth resonant column 136, the seventh resonant column 137, and the eighth resonant column 138. The regulating bolts 122 are moved along a direction perpendicular to the cover 12 to regulate a first distance between the regulating bolts 122 and the coupling holes 146 of the flange 144 and a second distance between the regulating bolts 122 and the connecting holes of the blend strips 15. A transmission zero of the filter 1 is regulated by changing the first distance and the second distance. Because the wings 157 and the connecting walls 158 cooperatively define a coupling space therebetween, a coupling area between the blend strip 15 and the regulating bolts 122 is increased. Thus, the transmission zero of the filter 1 can be regulated in a more broad range.

It is believed that the present embodiments and their advantages will be understood from the foregoing description, and it will be apparent that various changes may be made thereto without deparconducting materialg from the spirit and scope of the disclosure or sacrificing all of its material advantages, the examples hereinbefore described merely being preferred or exemplary embodiments.

What is claimed is:

1. A blend strip used in a filter to transmit an electrical signal, comprising:

a main body comprising an upper part, a lower part bent downwards relative to the upper part, a pair of wings corresponding extending upwards from two opposite first sides of the lower part, a pair of connecting walls extending upwards from two opposite second sides of the lower part and interconnecting with the upper part, and the first sides vertical to the second sides; and a pair of arms correspondingly extending from two opposite ends of the main body towards a same direction;

wherein the lower part is located at a center of the main body, and the wings extend along a direction perpendicular to a plane defined by the main body and the arms;

wherein the wings and the pair of connecting walls cooperatively define a coupling space therebetween.

2. The blend strip of claim 1, wherein the arms are substantially perpendicular to a longitudinal direction of the main body.

3. The blend strip of claim 1, wherein the lower part comprises a bottom plate parallel to the upper part and the blend strip is formed as an integrated molding.

4. The blend strip of claim 1, wherein each wall of the pair of connecting walls is substantially perpendicular to the upper part.

5. The blend strip of claim 3, wherein the lower part defines a connecting through hole at a center of the bottom plate, and the blend strip is fastened to the filter via the connecting through hole.

6. A filter, comprising:

a case;

a plurality of resonant columns received in the case, wherein the resonant columns are divided into at least two groups and the resonant columns of one same group are lined along a same direction;

a plurality of partition walls received in the case and located between the adjacent resonant columns of the one same group;

a plurality of blend strips fastened on the partition walls, each of the blend strips comprising a main body comprising an upper part, a lower part bent downwards relative to the upper part, a pair of wings corresponding extending upwards from two opposite first sides of the lower part, a pair of connecting walls extending upwards from two opposite second sides of the lower part and interconnecting with the upper part, and the first sides vertical to the second sides; and a cover covering the case;

wherein the case comprises a signal input port connected to one of the resonant columns or a signal output port connected to another one of the resonant columns, a signal is input to the case via the signal input port and is transmitted to the output port via a first path alternately passing through the resonant columns of the at least two groups and a second path passing through the blend strips and the resonant columns.

7. The filter of claim 6, wherein each of the blend strips further comprises a pair of arms correspondingly extending from two opposite ends of the main body towards a same direction.

8. The filter of claim 7, wherein the lower part is located at a center of the main body, and the wings extend along a direction perpendicular to a plane defined by the main body and the arms.

9. The filter of claim 7, wherein the arms are substantially perpendicular to a longitudinal direction of the main body.

10. The filter of claim 7, wherein the lower part comprises a bottom plate parallel to the upper part and the pair of connecting walls interconnecting the bottom plate with the upper part.

11. The filter of claim 10, wherein each wall of the pair of connecting walls is substantially perpendicular to the upper part.

12. The filter of claim 10, wherein the lower part defines a connecting through hole at a center of the bottom plate, and the blend strip is fastened to the filter via the connecting through hole.

13. The filter of claim 6, wherein the case comprises a base board and sidewalls extending from a periphery of the base board.

14. The filter of claim 6, wherein the wings and the connecting walls cooperatively define a coupling space therebetween.

15. The filter of claim 6, wherein the cover defines a plurality of regulating through holes aligned to the resonant columns and the blend strips, the cover comprises a plurality of regulating bolts passing through the regulating through holes and coupling with the resonant columns and the blend strips, and the regulating bolts moves in the regulating through holes to regulate a transmission zero of the filter.

16. The filter of claim 15, wherein the blend strip is formed as an integrated molding.

17. The filter of claim 15, wherein the pair of arms is corresponding aligned to the two adjacent resonant columns but do not contact the resonant columns.

* * * * *